US008701583B2

(12) United States Patent
Boschoff et al.

(10) Patent No.: US 8,701,583 B2
(45) Date of Patent: Apr. 22, 2014

(54) HYDROFOIL-ASSISTED MULTI-HULLED WATERCRAFT

(75) Inventors: Willem Hendrik Boschoff, Strand (ZA); Andrew Bruce Taylor, Stellenbosch (ZA); Günther Migeotte, Atlantis (ZA)

(73) Assignee: Cape Advanced Engineering (Pty) Ltd, Atlantis (ZA)

( * ) Notice: Subject to any disclaimer, the term of this patent is extended or adjusted under 35 U.S.C. 154(b) by 767 days.

(21) Appl. No.: 12/304,591

(22) PCT Filed: Jun. 13, 2007

(86) PCT No.: PCT/IB2007/052240

§ 371 (c)(1),
(2), (4) Date: Apr. 28, 2011

(87) PCT Pub. No.: WO2008/007249

PCT Pub. Date: Jan. 17, 2008

(65) Prior Publication Data

US 2011/0247541 A1 Oct. 13, 2011

(30) Foreign Application Priority Data

Jun. 13, 2006 (ZA) ..... 2006/04872

(51) Int. Cl.
*B63B 1/24* (2006.01)
*B63B 1/26* (2006.01)

(52) U.S. Cl.
USPC ..... 114/274

(58) Field of Classification Search
USPC ..... 114/271, 274, 278, 283, 288, 292, 61.1, 114/61.12, 61.13, 61.14, 61.2
See application file for complete search history.

(56) References Cited

U.S. PATENT DOCUMENTS

| | | | | |
|---|---|---|---|---|
| 4,606,291 | A * | 8/1986 | Hoppe | 114/274 |
| 4,989,534 | A * | 2/1991 | Field | 114/289 |
| 6,164,235 | A | 12/2000 | Hoppe | |
| 6,354,236 | B1 * | 3/2002 | Davidson | 114/271 |
| 7,845,302 | B2 * | 12/2010 | Loui et al. | 114/291 |

FOREIGN PATENT DOCUMENTS

| | | |
|---|---|---|
| EP | 0 352 195 | 1/1990 |
| WO | 03/070555 | 8/2003 |

* cited by examiner

*Primary Examiner* — Daniel V Venne
(74) *Attorney, Agent, or Firm* — Ladas & Parry LLP

(57) ABSTRACT

A catamaran (10) has two spaced demihulls (12) which are connected by an upper superstructure above the waterline. The catamaran (10) includes a main hydrofoil (26) extending between the demihulls at keel level slightly forward of the longitudinal center of gravity LCG (22) of the catamaran. Each demihull (12) defines an aft swept step formation (28) located slightly forward of the LCG (22) and extending transversely relative to a longitudinal center line CL defined between the demihulls. Each step formation (28) defines a step extending along a straight line and having a height dimension which tapers from an inner position at the keel (18) of the hull towards an outer position at the chine (20) of the hull. Each demihull defines a planing region immediately in front of the step formation (28), which has a concave hydrodynamic profile configured to generate lift on a wetted area of the hull.

8 Claims, 4 Drawing Sheets

HYDROFOIL-ASSISTED MULTI-HULLED WATERCRAFT

FIELD OF INVENTION

This invention relates to a hydrofoil-assisted multi-hulled watercraft.

BACKGROUND TO THE INVENTION

Hydrofoil systems for high speed watercraft are used extensively in order to improve the performance of such watercraft. Hydrofoil systems are used primarily to provide a reduction in friction resistance of a watercraft as it travels through water. This is achieved by supporting part of the vessel weight on the hydrofoil and in so doing, allowing the hydrofoil to lift the hull partially out of the water. This has the effect of reducing the wetted area and in turn, the water friction resistance of the hull.

U.S. Pat. No. 1,779,075 discloses a monohull boat of the hydroplane type in which speed and weight carrying ability are of paramount importance. The boat includes a fan-shaped hydroplane element at the stern of the boat to trim the boat and an elongate shouldered portion. Both the shouldered portion and the hydroplane are disposed in the same longitudinal flow stream.

U.S. Pat. No. 4,606,291 discloses a catamaran type boat having two spaced apart hulls and a hydrofoil which is located substantially in the vicinity of the longitudinal center of gravity of the boat.

U.S. Pat. No. 6,164,235 discloses a hydrofoil supported watercraft having a front hydrofoil located near the bow of the watercraft and a rear hydrofoil positioned to the rear of the longitudinal center of gravity of the watercraft, the front and rear hydrofoils being at least partially disposed in separate longitudinal flow streams.

It is an object of the present invention to improve the performance of hydrofoil-assisted multi-hulled watercraft.

SUMMARY OF INVENTION

According to the invention there is provided a hydrofoil-assisted multi-hulled watercraft having a longitudinal center of gravity and including at least two hulls which define a longitudinal center line between them, the hulls being spaced apart and connected by an upper superstructure spaced above the waterline so as to define a tunnel between the hulls, the watercraft including a hydrofoil which extends between the hulls at a position wherein the center of lift of the hydrofoil is disposed proximate and relatively forward of said longitudinal center of gravity of the watercraft, each hulls defining an elongate step formation which is disposed proximate and relatively forward of the longitudinal center of gravity of the watercraft and which extends transversely relative to said longitudinal center line.

Each step formation may extend along a straight line between an inner position at the keel of a particular one of the hulls and an outer position at the chine of the hulls.

Each hull may define a planing region which is disposed immediately in front of the step formation and which has a cambered hydrodynamic profile which is configured to generate lift on a wetted surface area of the hulls, in use.

The planing region may have a generally concave profile.

Each step formation may define a step having a configuration wherein a height dimension of the step tapers in a direction from the inner position of the step formation towards the outer position thereof.

The hydrofoil may be disposed substantially at the depth of the keels of the hulls.

The hydrofoil has opposite outer ends which may each be disposed adjacent the inner position of a different one of the step formations such that the hydrofoil and the step formations, in combination, effectively form a continuous wing wherein the hydrofoil and each step formations is disposed in different longitudinal flow streams.

The watercraft may be the form of a catamaran including two hulls.

In another embodiment, the watercraft may be in the form of a trimaran including three hulls wherein one of the hulls is a center hull and the other two hulls are outriggers, wherein each outrigger is transversely spaced from a different side of the center hull, the center hull defining said longitudinal center line, the watercraft including two of said hydrofoils wherein each hydrofoil extends between the center hull and a different one of the outriggers, each outrigger defining one of said elongate step formations and the center hull defining a pair of said elongate step formations wherein each step formation of the pair extends between said inner position at the keel of the center hull and an outer position at a different one of the chines of the center hull.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF THE PREFERRED EMBODIMENT

Figure 1:
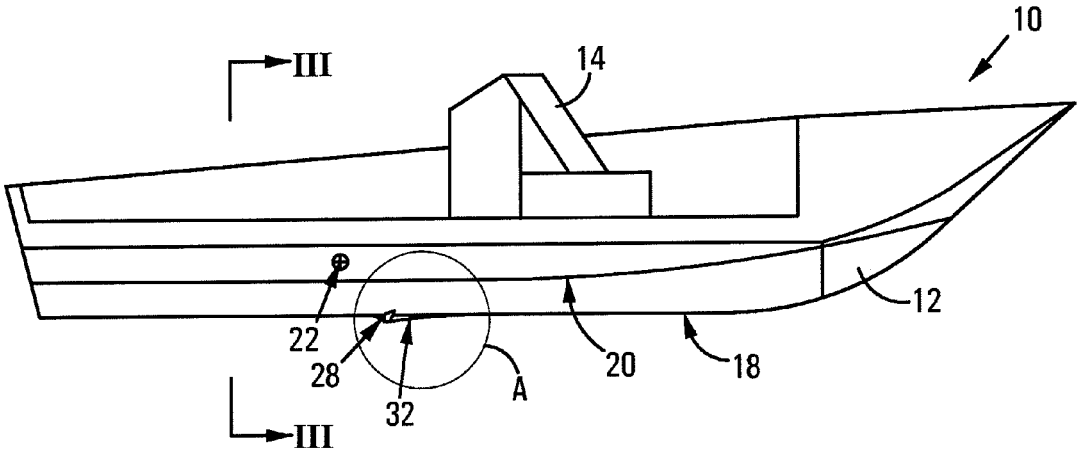
FIG. 1 shows a sectional side view of a hydrofoil-assisted catamaran watercraft in accordance with the invention.
Figure 2:
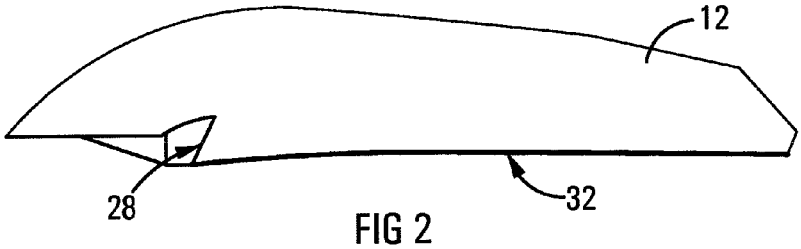
FIG. 2 shows an enlarged schematic view of detail A of FIG. 1.
Figure 3:
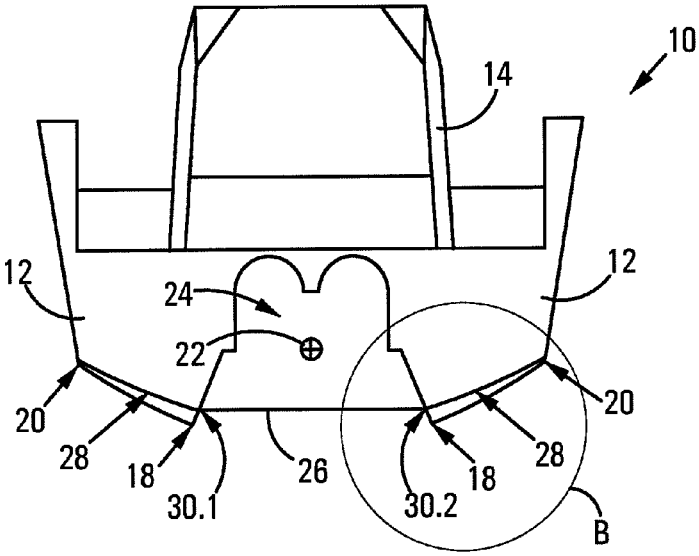
FIG. 3 shows a schematic sectional end view of the watercraft of FIG. 1, sectioned along section line III-III of FIG. 1.
Figure 4:
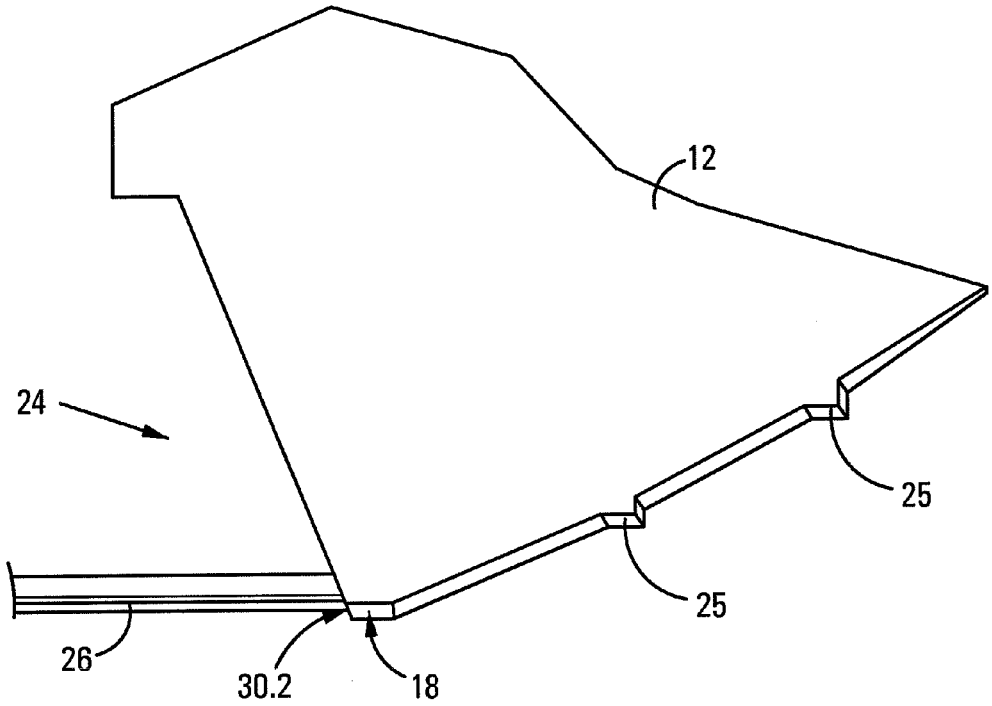
FIG. 4 shows an enlarged schematic view of detail B of FIG. 3.
Figure 5:
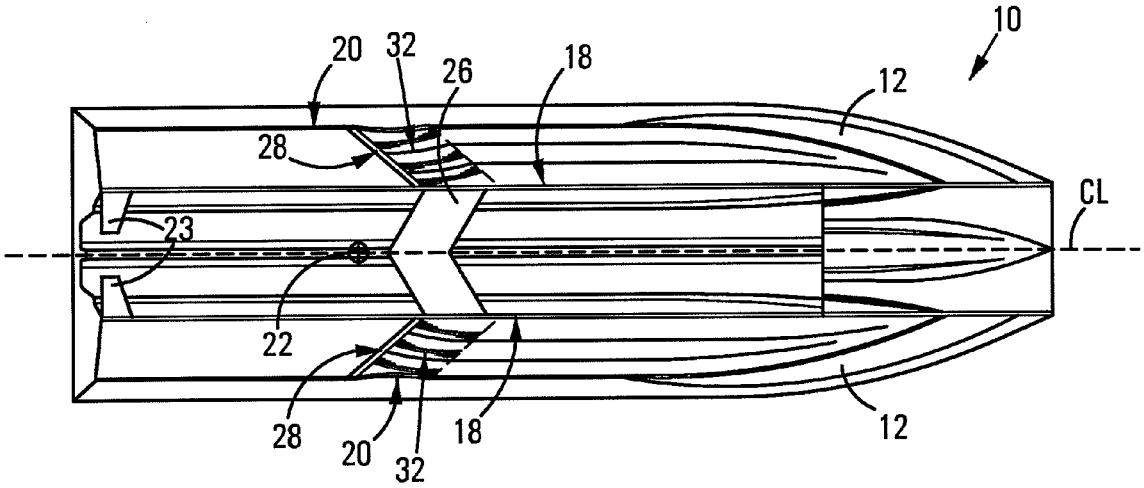
FIG. 5 shows a schematic plan view of the underside of the watercraft of FIG. 1.
Figure 6:
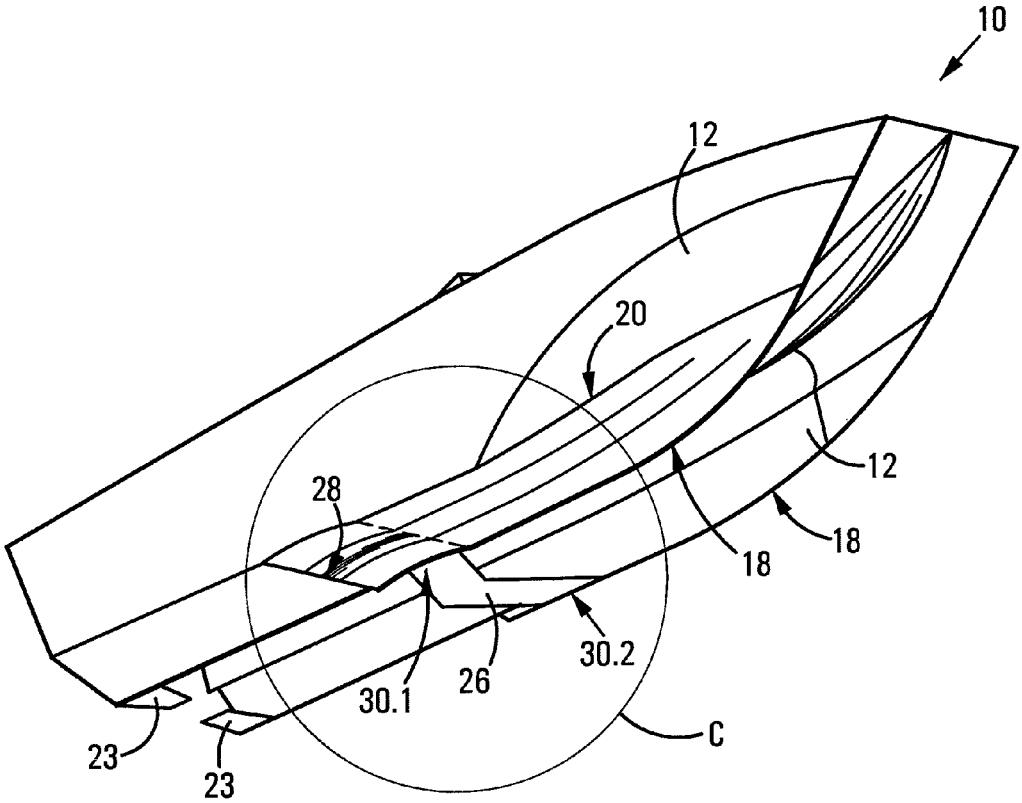
FIG. 6 shows a schematic perspective view from the underside, of the watercraft of FIG. 1.
Figure 7:
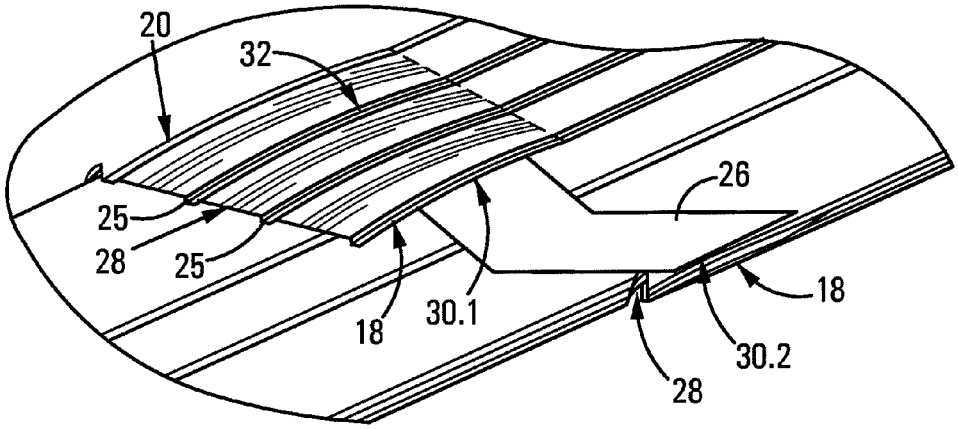
FIG. 7 shows an enlarged schematic view of detail C of FIG. 6.

With reference to FIGS. 1 to 7 of the drawings, a hydrofoil-assisted multihulled watercraft in accordance with the invention, is in the form of a high speed catamaran, is designated generally by the referenced numeral 10. The catamaran 10 has two hulls 12 which are transversely spaced apart and connected by an upper superstructure 14 which is above the waterline.

Each demihull 12 defines a keel 18 and an outer chine 20 which extends for the length of the hull. The catamaran has a longitudinal center of gravity (LCG) 22 located along a longitudinal center line CL defined between the hulls 12.

The hulls 12 and the superstructure 14 define a tunnel 24. The catamaran 10 includes a main hydrofoil 26 which extends across the tunnel between the hulls 12 at keel level. The hydrofoil 26 is disposed proximate and relatively slightly forward of the LCG 22. The hulls 12 include a pair of trim hydrofoils 23 which are located near the stern of the catamaran and which each extend inwardly from a different one of the hulls into the tunnel 24 at a lower position of each hull near the keel 18. The trim hydrofoils 23 create lift at the stern of the vessel in order to balance the moment created by the lifting forces in front of the LCG and are attached to the hulls or adjusted so as to ensure optimal running trim angle.

Each hull 12 defines an aft swept elongate step formation 28 which extends transversely with respect to the longitudinal center line CL. Each step formation 28 extends along a straight line between an inner position at the keel 18 and an outer position at the chine 20. The step formations 28 are disposed proximate and slightly forward of the LCG 22 of the watercraft and extend rearwardly at an angle relative to the longitudinal center line CL. Furthermore, each step formation defines a step having a configuration wherein a height dimension of the step tapers in a direction from the inner position of the step formation towards the outer position thereof. Each hull 12 further defines a pair of spray rails 25 at each side of the hull, which extend forwards from each step formation 28 to a position near the front of the hull.

The main hydrofoil 26 has opposite ends 30.1 and 30.2 which are each disposed adjacent the inner position of a different one of the step formation such that the hydrofoil 26 and the step formations, in combination, effectively form a continuous wing.

Each hull 12 defines a planing region 32 which is disposed immediately in front of the step formation and which has a cambered hydrodynamic profile which is configured to generate lift on a wetted surface area of the hulls, in use. More particularly, the planing region has a generally concave profile.

In use, the main hydrofoil 26 and the step formations run in different longitudinal flow streams. In particular, the keels of the hulls effectively fence the hydrofoil at opposite sides thereof so that the hydrofoil operates in relatively undisturbed, flat water which is channeled down the tunnel 24. By locating the step formations 28 slightly forward of the LCG of the watercraft, the forward part of each hull is disposed at a deeper level below the waterline than the aft part of the hull. This enables the shallow aft part of each hull to partially or completely emerge from the water at high speeds as the deeper forward part of each hull carries the weight of the watercraft, resulting in a significant reduction in hull drag.

A hydrofoil-assisted watercraft has a much better lift to drag ratio than a similar unassisted conventional watercraft. It is therefore able to carry the weight of the watercraft more efficiently than a conventional watercraft. The lift (or weight carrying capacity) of the hydrofoil increases with the velocity of the watercraft squared. The lift created by the hydrofoil decreases, however, as the hydrofoil approaches the water surface, the decrease commencing at approximately one cord length and reaching a minimum lifting capacity as the hydrofoil breaks the water surface. This surface effect facilitates passive control of the running depth of the watercraft.

The cambered planing region 32 of each hulls 12 is located at a position relatively higher than the position of the main hydrofoil 26 and specifically designed so as to encompass the entire medium speed wetted area of each hull. A substantial portion of the cambered planing region 32 is also located outside and above the high speed wetted area. It will be appreciated that the exact size, configuration and position of the planing region will depend on the design speed and the desired performance characteristics of the watercraft. The concave hydrodynamic profile of the cambered planing region is configured so as to increase the lift to drag ratio of the wetted hull area and as such, achieves a far greater lift to drag ratio than is the case with a conventional prismatic planing hull of similar design. The cambered planing region 32 of each hull 12 facilitates passive control of the running depth of the watercraft as it is possible to vary the proportion of the cambered planing region which is submerged thereby increasing the lift to drag ratio of the wetted hull area, by varying the speed of the watercraft.

It will be appreciated that the continuous wing formed by the hydrofoil 26 and the step formations 28, has a higher lift efficiency than would be provided by either of the hydrofoil and the step formations separately, due to positive interference effects between the hydrofoil and the step formations. These positive interference effects also have the effect of increasing the aspect ratio of the hydrofoil and the step formations.

In use, at low speeds, while the watercraft is still in displacement mode, the weight of the watercraft is carried by the hulls. Neither the main hydrofoil 26 nor the cambered planing regions 32 generate any significant lift. As the speed of the watercraft increases, the dynamic lift created by the hydrofoil 26 and by the cambered planing regions 32 increases proportional to the speed of the watercraft squared, and increasingly more of the weight of the watercraft is carried by the hydrodynamic lifting surfaces of the cambered planing regions 32 and the hydrofoil 26.

As the watercraft reaches low planing speeds, part or all of the hulls aft of the step formations 28 emerge from the water, resulting in a drastic reduction in drag. In this condition, most of the weight of the vessel is carried by the cambered planing regions 32, the main hydrofoil 26 and the trim hydrofoils located near the stern, resulting in an increased lifting efficiency over that provided by similar conventional planing hulls.

As the speed of the watercraft increases further, the lift created by the hydrodynamic lifting surfaces of the cambered planing regions 32 and by the main hydrofoil 26 increases exponentially, resulting in the draft of the watercraft decreasing, i.e. the vessel lifts higher out of the water, consequently reducing drag acting on the vessel. However, as the draft of the watercraft decreases, sections of the cambered planing regions 32 emerge from the water and the emersion depth of the hydrofoil 26 decreases, resulting in a gradual decrease in the extent to which the total hydrodynamic lift acting on the watercraft increases. This results in an automatic self-regulation of hydrodynamic lift, creating a state of equilibrium between lift and speed of the watercraft. This automatic self-regulation of lift can best be understood by considering the performance of the watercraft in rougher water conditions. When the watercraft traveling at a relatively high planing speed, encounters a wave, the draft of the watercraft increases, thereby increasing the drag acting on the vessel. The increased draft will also increase the wetted area of the cambered planing area and the emersion of the hydrofoil 26, resulting in an increase in hydrodynamic lift generated. This results in the vessel lifting higher out of the water, reducing its drag and also limiting the increase in lift, to re-establish the state of equilibrium. This provides the catamaran with a very good sea-keeping ability. Furthermore, the catamaran exhibits reduced slamming and acceleration in heave, roll and pitch conditions.

Figure 8:
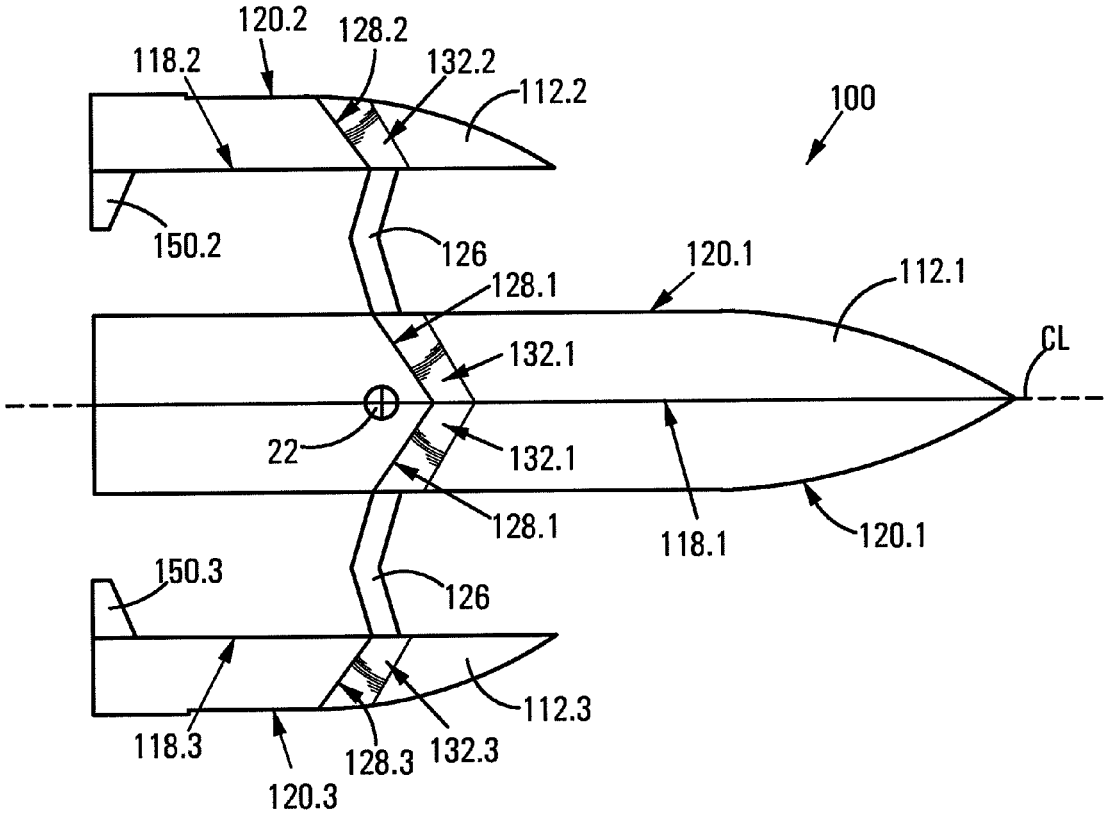
FIG. 8 shows a plan view of the underside of a hydrofoil-assisted trimaran watercraft in accordance with the invention.

With reference to FIG. 8 of the drawings, a watercraft in accordance with another embodiment of the invention, which is in the form of a trimaran, is designated generally by the referenced numeral 100. Features of the trimaran 100 which are the same as or similar to those of the catamaran 10, are designated by the same and/or similar reference numerals. The trimaran 100 includes three hulls wherein one of the hulls is a center hull 112.1 and the other two hulls are outriggers

112.2 and 112.3. Each of the outriggers 112.2 and 112.3 is transversely spaced from a different side of the center hull 112.1. The center hull 112.1 defines the longitudinal center line CL, with the LCG 22 of the trimaran 100 being located along the longitudinal centre line CL as is the case for the catamaran 10.

The trimaran 100 includes two main hydrofoils 126 which each extend between the center hull and a different one of the outriggers 112.2 and 112.3. More particularly, outer ends of the hydrofoils 126 are attached to the outriggers 112.2 and 112.3 adjacent the keels 118.2 and 118.3 thereof, respectively.

The outriggers 112.2 and 112.3 define aft swept step formations 128.2 and 128.3, respectively, wherein each step formation extends between an inner position at the keel 118 of the outrigger to an outer position at the chine 120 of the outrigger. As for the hulls of the catamaran 10, the chines 120.2 and 120.3 of the outriggers 112.2 and 112.3, respectively, extend for the length of the outriggers.

The center hull 112.1 defines a pair of step formations 128.1 wherein each step formation 128.1 of the pair extends between an inner position at the keel 118.1 of the center hull and an outer position at a different one of the chines 120.1 of the center hull. As such, in similar fashion to the catamaran 10, the hydrofoils 126 and the step formations of the center hull and the outriggers, in combination, effectively form a continuous wing. The center hull 112.1 defines two planing regions 132.1 which are disposed immediately in front of a different one of the step formations 128.1. The planing regions 132.1 have cambered hydrodynamic profiles equivalent to that of the planing region 32 of each hull 12 of catamaran 10. Similarly, the outriggers 112.2 and 112.3 define planing regions 132.2 and 132.3 which are disposed immediately in front of the step formations 128.2 and 128.3, respectively and which are equivalent in form and function to the planing regions 32 of the catamaran 10.

The trimaran 100 includes a pair of trim hydrofoils 150.2 and 150.3 at the stern of the trimaran, which create lift at the stern in order to balance the moment created by the lifting forces in front of the LCG. The trim hydrofoils each extend inwardly from a different one of the outriggers at a lower position of each outrigger near the keel thereof.

It will be appreciated that the performance characteristics of the step formations, planing regions and main hydrofoils of the trimaran 100 are equivalent to that described in respect of the step formations, main hydrofoil and planing region described hereinabove in relation to the catamaran 10.

The invention claimed is:

1. A hydrofoil-assisted multi-hulled watercraft having a longitudinal center of gravity and including at least two hulls which define a longitudinal center line between the hulls, the hulls being spaced apart and connected by an upper superstructure spaced above a waterline so as to define a tunnel between the hulls, the watercraft including a hydrofoil which extends between the hulls at a position wherein a center of lift of the hydrofoil is disposed proximate and relatively forward of said longitudinal center of gravity of the watercraft, each hull defining an elongate step formation which is disposed proximate and relatively forward of the longitudinal center of gravity of the watercraft and which extends transversely relative to said longitudinal center line, the hydrofoil having opposite outer ends which are each disposed adjacent an inner position of a different one of the elongate step formations in an arrangement wherein the hydrofoil and each elongate step formations is disposed in a different longitudinal flow stream.

2. The watercraft as claimed in claim 1, wherein each elongate step formation extends along a straight line between an inner position at a keel of a particular one of the hulls and an outer position at a chine of the hull.

3. The watercraft as claimed in claim 1, which is a catamaran including two of said hulls.

4. The watercraft as claimed in claim 2, wherein each hull defines a planing region which is disposed immediately in front of the elongate step formation and which has a cambered hydrodynamic profile which is configured to generate lift on a wetted surface area of the hulls, in use.

5. The watercraft as claimed in claim 2, wherein the hydrofoil is disposed substantially at a depth of the keels of the hulls.

6. The watercraft as claimed in claim 2, which a trimaran including three of said hulls wherein one of the hulls is a center hull and the other two hulls are outriggers, wherein each outrigger is transversely spaced from a different side of the center hull, the center hull defining said longitudinal center line, the watercraft including two of said hydrofoils wherein each hydrofoil extends between the center hull and a different one of the outriggers, each outrigger defining one of said elongate step formations and the center hull defining a pair of said elongate step formations wherein each elongate step formation of the pair of elongate step formations extends between said inner position at the keel of the center hull and an outer position at a different one of the chines of the center hull.

7. The watercraft as claimed in claim 4, wherein the planing region has a generally concave profile.

8. The watercraft as claimed in claim 7, wherein each elongate step formation defines a step having a configuration wherein a height dimension of the step tapers in a direction from the inner position of the step formation towards the outer position thereof.

* * * * *